US005303932A

United States Patent [19]

Kessler

[11] Patent Number: 5,303,932

[45] Date of Patent: Apr. 19, 1994

[54] GAME APPARATUS

[75] Inventor: Brian D. Kessler, Youngstown, Ohio

[73] Assignee: Maui Toys, Inc., Youngstown, Ohio

[21] Appl. No.: 19,561

[22] Filed: Feb. 18, 1993

[51] Int. Cl.[5] ..... A63B 61/00

[52] U.S. Cl. ..... 273/411; 273/29 BB

[58] Field of Search ..... 273/411, 29 B, 29 BB, 273/30

[56] References Cited

U.S. PATENT DOCUMENTS

| | | | |
|---|---|---|---|
| 1,327,072 | 1/1920 | Thorward | 272/29 BB |
| 2,150,033 | 3/1939 | Hillson | 273/30 |
| 3,966,205 | 6/1976 | Schain et al. | 273/29 A |
| 3,968,968 | 7/1976 | Peterson | 273/411 |
| 4,022,471 | 5/1977 | Keller | 273/411 |
| 4,093,224 | 6/1978 | Hale | 273/411 |
| 4,135,716 | 1/1979 | Ginsburg | 273/29 BC |
| 4,357,019 | 11/1982 | Wouters | 273/411 |
| 4,415,163 | 11/1983 | Schoenig | 273/411 |
| 4,720,112 | 1/1988 | Stettner et al. | 273/411 |
| 4,830,382 | 5/1989 | Wheeler | 273/411 |
| 4,948,149 | 8/1990 | Lin et al. | 273/411 |
| 4,979,754 | 12/1990 | Eisenhart | 273/411 |

*Primary Examiner*—William H. Grieb

*Attorney, Agent, or Firm*—Browdy and Neimark

[57] ABSTRACT

A game apparatus, especially adapted for children's volleyball includes a net, a pair of standard supporting the ends of the net, and a pair of bases each supporting one of the standard. The standards are formed from two plastic interfitting and telescoping tubes so that the net is height adjustable in a simple way, the two tubes frictionally inter-engaging with one another. The net is provided with integral sleeves at each end which fit over the upper tubes of the standards. The standards are supported in the basis in such way so that they extend upwardly and outwardly, diverging the bottom to the top in an outward direction. The bases are hollow and capable of receiving ballast, e.g. water or sand, and retaining the ballast without leakage. In addition, the larger portion of each base extends inwardly toward the center of the net from the standard, with a smaller portion extending outwardly from the standard.

18 Claims, 3 Drawing Sheets

10
12
14
16
18
20
22
25
26
27
28
29
30
31

FIG. 4
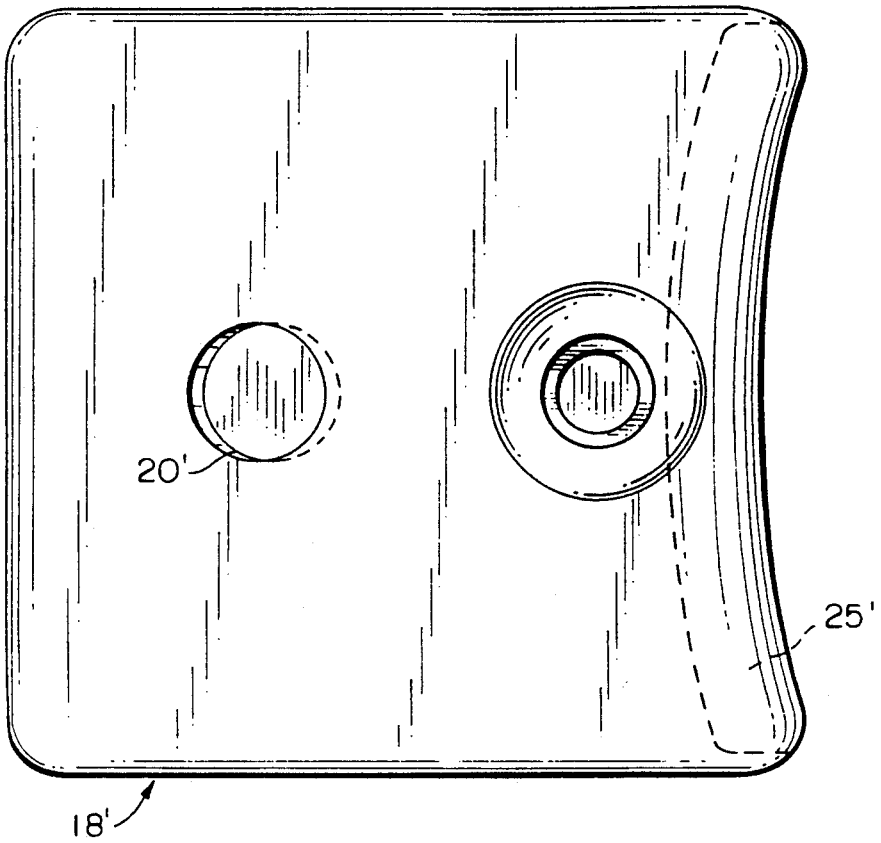
FIG. 5
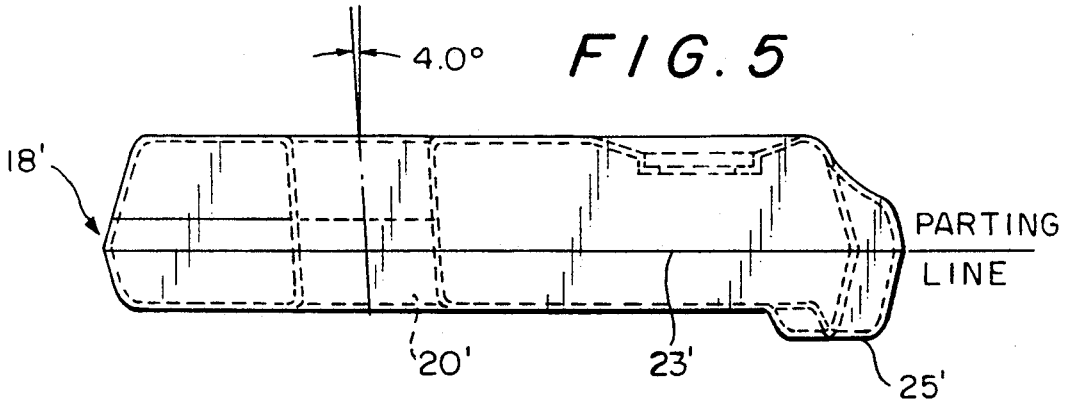
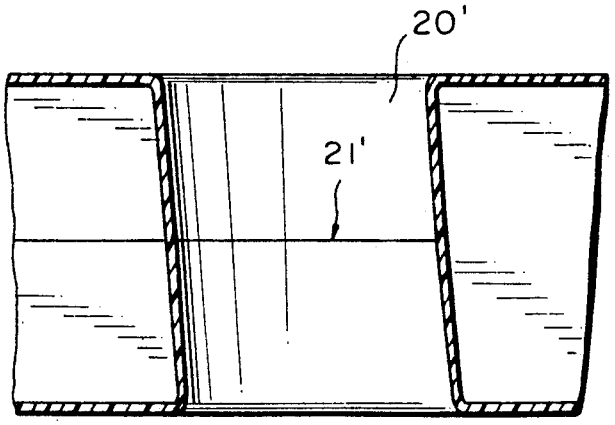
FIG. 6

GAME APPARATUS

FIELD OF INVENTION

The present invention relates to a net game apparatus especially for volleyball, tennis, etc., and particularly adapted for use by children.

BACKGROUND OF THE INVENTION

Apparatus for games such as volleyball, played for non-professional, recreational purposes, especially for children's play, are normally inconvenient to carry and set up and are too expensive. There is a large body of prior art which shows various ways of supporting volleyball and other game nets, and which require guy wires, anchors, tightening ropes, ballast bags, heavily weighted bases and the like, all of which suffer from at least one of the deficiencies of being too expensive, inconvenient and difficult to handle and carry, and/or which are ineffective.

Included among these are the devices shown in the Peterson U.S. Pat. No. 3,968,968 and Eisenhart U.S. Pat. No. 4,979,754. Peterson discloses a game apparatus for playing mini-volleyball which can be used on beach sand. Eisenhart discloses a portable beach game apparatus. Both of these constructions utilize weighted bases to provide stability for their respective net posts, but in the case of Peterson the construction is too heavy if the weighted bases are to be effective. Thorward U.S. Pat. No. 1,327,072 and Hale U.S. Pat. No. 4,093,224 also show weighted bases, as well as means for adjusting the height of the net on the posts.

A number of other prior patents also show various means for adjusting the net height, including telescoping net posts or standards, these including the U.S. patents to Stettner et al U.S. Pat. No. 4,720,112; Lin et al U.S. Pat. No. 4,948,149; Wheeler U.S. Pat. No. 4,830,382; and Ginsburg U.S. Pat. No. 4,135,716. For the most part, however, these require bolts or pegs or the like to hold the posts in proper position relative to one another.

SUMMARY OF THE INVENTION

It is, accordingly, an object of the present invention to overcome deficiencies of the prior art, such as those indicated above.

It is another object of the present invention to provide a game apparatus especially for volleyball, tennis, paddle ball or the like, and particularly adapted for use by children indoors and outdoors such as for yard and beach use, and which is inexpensive, effective and convenient, and easy to handle, carry and use.

It is another object of the present invention to provide a game kit including at least a game net, standards for holding the ends of the net upright to properly position the net, a base to support each standard, and a ball, and optionally including paddles or rackets, the kit being easily converted to a game apparatus especially adapted for use by children indoors or outdoors.

Yet another object of the present invention is to provide a game apparatus, especially for volleyball, tennis or the like, which is simple in construction and thus is readily manufactured at a low cost.

Yet a further object of the present invention is to provide such a game apparatus which comprises only a few parts thereby making its assembly very easy, while yet retaining high reliability.

Still another object of the present invention is to provide such a game apparatus which is readily erectable for use on a beach or grass and which does not require the use of potentially dangerous stakes and guy wires for net support.

It is still a further object of the present invention to provide such a game apparatus in which the net is less likely to sag and in which undesirable inward tilting of the standards or posts is inhibited.

The above and other objects are achieved according to the present invention by providing a pair of hollow bases capable of receiving ballast for holding standards supported therein in a properly upwardly oriented direction in turn supporting the net, these bases being especially characterized by having their standards supporting recesses inclined from the vertical at an angle s that such standards initially diverge way from one another, the weight and tension of the net then serving to pull the upper ends of the standards toward one another to make the standards assume a more vertical attitude. The bases are also characterized in that the standard receiving recesses are provided closer to the outer ends of the bases than the inner ends, so that the pivot axis between the bottom edge of the inside end of the base and the ground is a greater distance from the foot of the standard so that inward tilting of the standards is further inhibited and the net is tautly held against sagging.

BRIEF DESCRIPTION OF DRAWINGS

Further objects and the nature and advantages of the present invention will be more apparent from the following detailed description of certain embodiments, taken in conjunction with the drawing wherein:

FIG. 4 is a plan view of a second embodiment of one of the parts of the present invention;

FIG. 5 is a side elevation of the part of FIG. 4; and

FIG. 6 is a cross-sectional view of a portion of the part of FIGS. 4 and 5, partly broken away.

DETAILED DESCRIPTION OF EMBODIMENTS

Figures 1, 3:
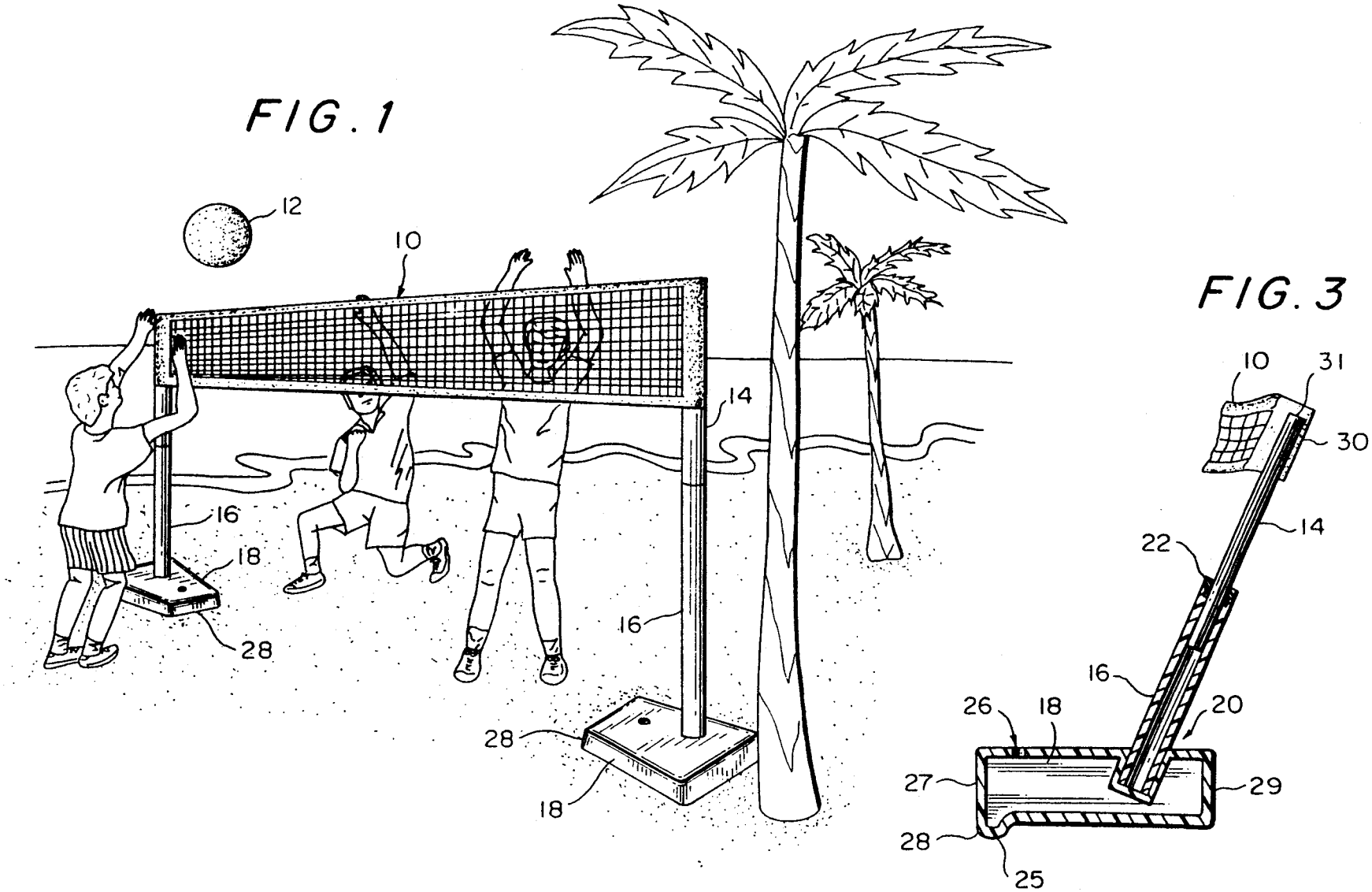
FIG. 1 is a perspective view of a game apparatus in accordance with the present invention, in the form of a volleyball apparatus.
FIG. 3 is partially broken away, partial sectional view, having exaggerated parts, showing the embodiments of FIGS. 1 and 2.
Figure 2:
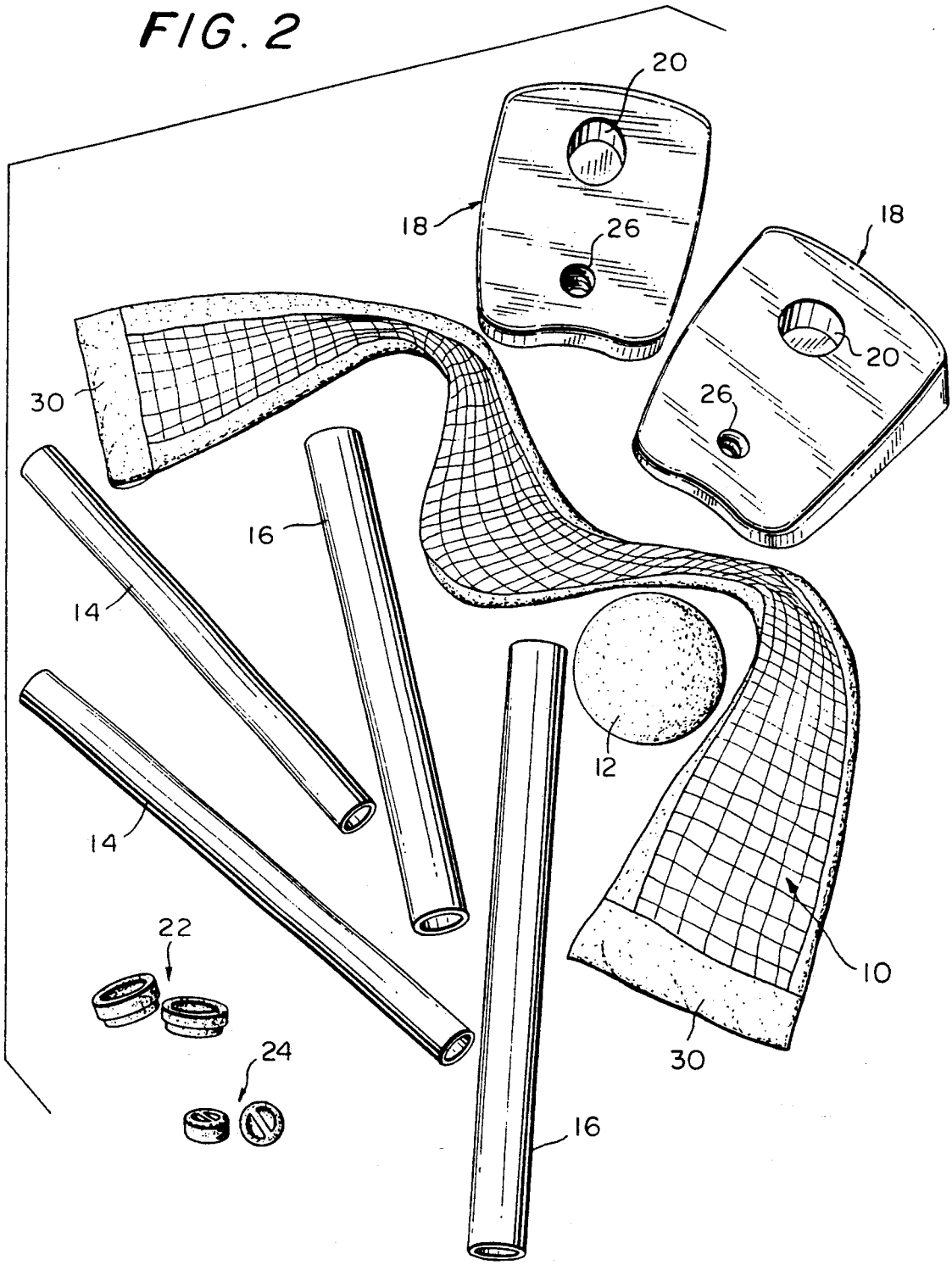
FIG. 2 is a perspective view of the various elements constituting the apparatus of FIG. 1, disassembled for packing in kit form.

With reference to FIG. 2, the component parts of a game apparatus according to the present invention, especially adapted for volleyball to be played on the beach or on the lawn or the like, include a net 10, a soft ball 12 such as one formed of sponge or foam elastomer, a pair of small height adjusting and net supporting upper poles or tubes 14, a pair of larger diameter base poles or tubes 16 for frictionally and telescopically receiving therein the small height adjusting poles or tubes 14, and a pair of bases 18 each having a recess 20 therein for receiving the lower end of the large base pole or tubes 16 for supporting engagement therewith. There may also be provided optional ring stoppers 22 formed of elastomer the function of which will be explained below, and an optional pair of plugs 24 for closing ballast receiving openings 26 in the bases 18. FIG. 1 shows in schematic perspective how the various elements are assembled.

Certain important details of the present invention will now be made more apparent with reference to FIG. 3 which shows that the recess 20 provided in the upper surface of each base 18 for receiving the bottom end of the large base pole or tube 16 is inclined at an angle from the vertical so that the standard, formed in this embodiment of the tubes 16 and 14, extends upwardly from the base 18 in a direction which increases away from the net 10 from the base to the upper end of the standard, i.e. the top of the small adjusting pole or tube 14. The angle of inclination is exaggerated in FIG. 3 for ease of understanding, it being understood that such angle however should be at least 5° and with respect to the horizontal ground is preferably in the range of 8° to 14°. The angle of inclination is achieved in either of two ways, preferably both together, i.e. by inclining the angle of the recess 20 and providing a ridge 25 at the bottom 28 of the inside end 27 of the base 18. Thus, the ridge 25 acts as a means for elevating the inside end 27 including the edge 28 of the base 18.

It will be understood that in the fully assembled state as shown in FIG. 1, with the net 10 being firmly tensioned as shown in FIG. 1, the bottom inside edge 28 of the base 18 will act as a hinge line when the standard 14, 16 assumes the vertical position as shown in FIG. 1. As all the weight of the standard 14, 16, the base 18 and the ballast within the base 18 will be on the outside of the hinge line defined by the bottom inside edge 28 beneath the ridge 25, the net will be held in strong tension and will not sag. When the game apparatus is erected on the sand, the edge 28 will tend to bite into the sand.

Each base 18 is, as clearly seen in FIG. 3, hollow for receiving ballast therein, e.g. water, sand, gravel, etc. through the opening 26, which opening 26 can be subsequently closed by the plug 24. Each of the bases 18 is desirably formed of molded plastic, e.g. PVC, polyolefin, etc. such as by blow molding, rotational casting or the like, in a simple and inexpensive manner. Also as shown in FIG. 3, the recess 20, which may extend entirely through the base 18, is so sized in relation to the base pole or tube 16 so that the base pole or tube 16 slidingly interfits therewithin in a frictionally tight manner. FIG. 3 is not drawn to scale, but instead shows the base 18 in an enlarged form relative to the standard 14, 16 and the net 10.

It will be further seen from FIG. 3 that the recess 20 is located so as to divide the base 18 into a long portion which extends inwardly to the inside end 27, and a short portion extending outwardly from the recess 20 to the outside end 29 of the base 18. This arrangement also helps to keep the net taut and prevents it from sagging during use, because the length of the moment arm from the hinge line defined by the edge 28 is thus increased.

FIGS. 4–6 show a second or alternative base 18′ generally consistent with the aforementioned base 18 and including a recess 20′ extending entirely through the base 18′, for receiving the bottom end of the large base pole or tube 16. As with the base 18, the base 18′ also has a ridge 25′ along its bottom inside edge. The base 18′ is preferably molded in a two-part mold by vacuum forming. Where the two mold parts meet, the base has a parting line 23′. In this embodiment, the through-recess 20′ is desirably inclined at an angle of 4° from the vertical. Coupled with the tilt provided by the ridge 25′, the standards retained within the through-recess 20′ will be inclined from the vertical about 8° to 14°, consistent with what is indicated above.

As perhaps can best be seen from the enlarged partial section of FIG. 6, the diameter of the through-recess 20′ is not consistent along its entire length. From an approximate midpoint defined by the plane 21′, which bisects the base 18′, the through recess 20′ slightly flares outwardly from a narrowmost portion to a slightly widened portion at either the top, the bottom or at both ends thereof. This means that the lower end of the standard can be held particularly tightly at the midpoint 21′ of the through-recess 20′ and, if only half of the through-recess 20′ is tapered, also by the untapered half, while some degree of pivot is permitted of the standard within the tapered half of the through-recess 20′. This arrangement provides an improved degree of anchoring of the standard within the base 18′, while at the same time improving the ease of coupling and/or uncoupling.

As noted above, the standard comprises the telescoping poles or tubes 14 and 16 for a volleyball apparatus or any other game apparatus requiring a net at a higher level. For a lower level nets such as for a tennis game apparatus, the small adjusting pole or tube 14 may be eliminated and the net 10 attached directly to the upper end of the large base pole or tube 16.

In the illustrated embodiment, however, both poles or tubes 14 and 16 are utilized, these being desirably extruded of suitable plastic such as PVC, polyolefin or the like, the inner and upper pole or tube 14 slidingly fitting and telescoping within the lower and outer pole or tube 16 as shown in FIG. 3, these tubes tightly interfitting with one another. For a good tight sliding fit, the outer diameter of the inner tube or pole 14 should be the same as the inner diameter of the outer tube or pole 16, or at most the inner diameter of the base pole or tube 16 should be no more than 0.015 inches greater than the other diameter of the small adjusting pole or tube 14.

To absolutely ensure that no movement of the small adjusting pole or tube 14 within the large base or tube 16 will occur, one of the elastomeric stopper rings 22 may be stretched over the upper pole 14 which it tightly grips; with the ring 22 in position as shown in FIG. 3, the ring will rest on the upper edge of the base pole or tube 16 to prevent any further telescoping of the upper pole or tube 14 into the lower pole or tube 16.

Another desirable feature of the present invention is the means with which the net 10 is supported at the upper end of the standard, e.g. the upper pole or tube 14. This is accomplished by providing the net 10 at its ends with integral sleeves 30 as best shown in FIG. 3, these suitably being either formed of plastic or of woven cloth, e.g. formed of synthetic fibers, or most preferably of heat sealed flexible plastic film. Forming the sleeves 30 of flexible film provides a flexible and more easily storable product, at the same time being very inexpensive. As seen in FIG. 3, the integral sleeves 30 are substantially closed at their upper ends 31 so as to fit over and encompass the upper ends of the upstanding standards to hold the net in position.

The present game apparatus is simple and inexpensive, easy to assemble and disassemble, and yet is highly effective particularly in its ability to keep the net 10 taut. The present game apparatus can be readily modified for different net games including yard tennis, net paddle ball, badminton or the like, and the kit can be modified to include paddles, rackets, badminton birdies, regular or modified tennis balls, etc.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. In a game apparatus comprising a net, a pair of upstanding standards each holding an end of said net, and a base for each standard, said base having an inside end and an outside end, the improvement wherein each said base has a recess in an upper surface thereof into which a lower end of said standard fits, said standard extending upwardly from said base at an angle from vertical in a direction which increases away from said net from said base to an upper end of said standard, and means for elevating said inside end of said base.

2. A game apparatus according to claim 1 wherein said angle is 8°-14°.

3. A game apparatus according to claim 2 wherein said recess is inclined at an angle from vertical of about 4°.

4. A game apparatus according to claim 1 wherein said lower end of said standard fictionally and slidingly interfits within said recess of said base.

5. A game apparatus according to claim 4 wherein each said base is hollow and constitutes means for holding ballast material therein without leakage, and an opening for passing ballast into and out from said base.

6. A game apparatus according to claim 5 wherein each said base is molded of plastic with said recess extending entirely therethrough.

7. A game apparatus according to claim 5 wherein said recess in said base portion is located so as to divide said base into a long portion extending inwardly in the direction of said net from said recess, and a short portion extending outwardly from said recess away from said net.

8. A game apparatus according to claim 5 wherein said net is provided at its ends with integral sleeves which are substantially closed at their upper ends, said integral sleeves fitting over and encompassing upper ends of said upstanding standards whereby said standards hold said net.

9. A game apparatus according to claim 1 wherein said means for elevating said inside end of said base comprises a downwardly extending ridge along a bottom inside end of said base.

10. A game apparatus according to claim 1 wherein each said standard comprises a lower and outer tube which fits into said recess, and an inner and upper tube which slidingly fits and telescopes within said lower and outer tube, said tubes being formed of plastic and tightly slidingly interfitting with one another.

11. A game apparatus according to claim 10 wherein the outer diameter of said inner tube and the inner diameter of said outer tube vary from 0 to 0.015 inches.

12. A game apparatus according to claim 1 wherein said net is provided at its ends with integral sleeves which are substantially closed at their upper ends, said integral sleeves fitting over and encompassing upper ends of said upstanding standards whereby said standards hold said net.

13. In a game apparatus comprising a net, a pair of upstanding standards each having an upper end and holding an end of said net, and a base for each said standard, the improvement wherein said net is provided at its ends with integral sleeves formed of a thin and flexible material, said integral sleeves fitting over said upper ends of said standards and being sufficiently closed at their upper ends to encompass said upper ends of said standards; each said base being hollow and defining an inclined standard-retaining recess extending entirely therethrough, said recess being formed by an inclined cylindrical wall having a flared section along a length thereof and a narrow section adjacent said flared section, said narrow section comprising means for tightly holding said standard while improving the ease of uncoupling.

14. A game apparatus according to claim 13 wherein each said standard comprises a lower and outer plastic tube which fits into said recess, and an inner and upper plastic tube which slidingly fits and telescopes within said lower and outer plastic tube, said plastic tubes tightly slidingly interfitting with one another.

15. A game apparatus according to claim 14 wherein the outer diameter of said inner tube and the inner diameter of said outer tube vary from 0 to 0.015 inches.

16. In a game apparatus comprising a net, a pair of upstanding standards each holding an end of said net, and a base for each said standard, the improvement wherein each said base comprises holding means for holding a lower end of one of said standards, each said holding means comprising an inclined standard-retaining recess extending entirely therethrough, said recess being formed by an inclined cylindrical wall having a flared section along approximately half its length thereof and a narrow section at approximately its midpoint thereof, said narrow section comprising means for tightly holding said standard while improving the ease of uncoupling, each said standard extending upwardly from a respective said base at an angle from vertical in a direction which increases away from said net from said base to an upper end of said standard.

17. A game apparatus according to claim 16 wherein each said standard comprises a lower and outer plastic tube which fits into said recess, and an inner and upper tube which slidingly fits and telescopes within said lower and outer tube, said tubes being formed of plastic and tightly slidingly interfitting with one another.

18. A game apparatus according to claim 17 wherein the outer diameter of said inner tube and the inner diameter of said outer tube vary from 0 to 0.015 inches.

* * * * *